US005794631A

United States Patent [19]

Sylvester

[11] Patent Number: 5,794,631

[45] **Date of Patent: *Aug. 18, 1998**

[54] GIFT/PRODUCT HOLDING SYSTEM

[75] Inventor: Elyse Sylvester, Bethel, Conn.

[73] Assignee: Sylvester Associates, Bethel, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 503,826

[22] Filed: Jul. 18, 1995

[51] Int. Cl.[6] ..... B65D 85/672

[52] U.S. Cl. ..... 206/387.1; 206/232; 206/308.1; 229/87.19; 229/923

[58] Field of Search ..... 206/387.1, 387.13, 206/307, 472, 474, 475, 451, 459.5, 232, 308.1, 309–313; 229/921–923, 87.18, 87.19, 141

[56] References Cited

U.S. PATENT DOCUMENTS

| | | | |
|---|---|---|---|
| 1,060,431 | 4/1913 | Dague | 229/141 |
| 3,198,420 | 8/1965 | Hiersteiner | 229/141 |
| 4,046,311 | 9/1977 | Voytko | 229/921 |
| 4,867,372 | 9/1989 | Patterson | 229/921 |
| 5,065,935 | 11/1991 | Mancel | 229/922 |
| 5,078,268 | 1/1992 | Olson et al. | 206/387.1 |
| 5,226,532 | 7/1993 | Davidson et al. | 206/457 |
| 5,232,087 | 8/1993 | Schluger | 206/387.1 |
| 5,249,670 | 10/1993 | Simon | 206/475 |
| 5,289,917 | 3/1994 | Chabria | 206/232 |
| 5,384,177 | 1/1995 | Rissmann | 206/459.5 |
| 5,469,965 | 11/1995 | Stearns | 206/387.1 |

*Primary Examiner*—Paul T. Sewell
*Assistant Examiner*—Luan K. Bui
*Attorney, Agent, or Firm*—Larson & Taylor

[57] ABSTRACT

A visually exciting decorative, easily assembled gift or product holding system is attained by providing a preformed central section, constructed for receiving and securely retaining a particular product having a fixed dimensional construction in combination with a movable, enlarged flap member attached to the central section and incorporating decorative indicia or preprinted messages thereon. By employing this construction, a unique, distinctive, preformed gift/product holding and mailing system is attained for quickly and easily receiving and securely holding products such as video cassettes, audio cassettes, compact discs, books, and the like in a visually exciting and interest generating manner. In the preferred embodiment, easily activated securement means are mounted on the holding system for sealing or closing the system when desired, to assure secure retention of the desired product therein.

19 Claims, 7 Drawing Sheets

GIFT/PRODUCT HOLDING SYSTEM

TECHNICAL FIELD

This invention relates to constructions for gift holding systems and, more particularly, to pre-printed, easily constructed gift holding systems for securely retaining a variety of fixed dimensioned items in an easily used, highly decorative, and aesthetically pleasing construction.

BACKGROUND ART

In order to promote festive or joyous occasions, it is traditional that gifts be given from one person to another. In addition, the gifts are usually wrapped in a suitable decorative manner. In this way, the joyous occasion or event for which the gift is intended to commemorate is enhanced. Typically, gifts are placed in a box which is then wrapped in suitable decorative paper consistent with the event being celebrated.

During the last several years, consumer interest in prerecorded audio tapes, compact discs, and video cassettes has increased at a rapid rate. In view of this increasing interest, many individuals have employed these products as gifts for being given to other individuals. However, in spite of the popularity of these products, no system presently exists in the prior art which can be employed as a pre-formed, decorative box specifically constructed for receiving these products and enabling the products to be easily given as a gift without further wrapping.

In addition to the prior art failure to provide a decorative box for enabling fixed size products, such as compact discs, audio cassettes, and video cassettes to be quickly and easily positioned in a decorative container, individuals wishing to give such items as a gift are also required to purchase greeting cards for the particular gift-giving occasion. As a result, additional effort and expense must be incurred.

Presently, these gift forming products are sold with wrappings or containers relating to the particular product. Some of these products, such as audio cassettes, may incorporate an enlarged container associated therewith for retaining the audio cassette and detailing the musical works contained on the cassette. Similarly, video cassettes are also typically sold with holders or containers upon which advertising information is provided regarding the particular movie and its contents.

Although some of these products are sold with containers for housing the actual cassette or compact disc, the container is constructed merely for informing the user of the contents found on the cassette and are not in any way intended as a decorative, gift-giving container which would enable the user to avoid having to wrap the entire product in wrapping paper or place the product in a suitable gift box for being presented to an individual for whom the product is intended.

Therefore, it is a principal object of the present invention to provide a decorative, pre-formed, easily employed gift holding system constructed for securely receiving and holding standard dimensioned products for enabling the product to be securely retained and easily presented to another as a gift without requiring separate wrapping or a separate container.

Another object of the present invention is to provide a decorative, pre-formed gift holding system having the characteristic features described above which is also constructed with a message delivery zone for enabling a suitable message to be easily provided by the giver to the recipient, thereby personalizing the gift and preventing the need for having a separate greeting card attached thereto.

Another object of the present invention is to provide a decorative, pre-formed gift holding system having the characteristic features described above which also incorporates a movable, decorative, visually pleasing panel, preferably constructed for being positionable in overlying relationship with the message delivery zone, thereby assuring personalization and confidentiality of any message placed thereon.

Another object of the present invention is to provide a decorative, pre-formed gift holding system having the characteristic features described above which is capable of being folded in a generally conventional manner for ease of storage, while also being quickly and easily formed into the desired configuration for receiving and holding the particular gift.

Another object of the present invention is to provide a decorative, pre-formed gift holding system having the characteristic features described above which is capable of incorporating a wide variety of visually stimulating indicia on the surfaces thereof as well as capable of having alterable visual images integrally associated therewith.

Other and more specific objects will in part be obvious and will in part appear hereinafter.

SUMMARY OF THE INVENTION

By employing the teaching of the present invention, all of the difficulties, drawbacks and limitations found in the prior art constructions are overcome, a unique, distinctive, and visually exciting enhanced pre-formed, decorative, easily assembled gift or product holding system is realized. In addition, by employing the present invention, numerous alternate visually distinctive constructions are attainable.

Furthermore, in addition to establishing a decorative, aesthetically pleasing, visually exciting, pre-assembled gift holding system, the preferred embodiment of the present invention also incorporates a pivotable panel upon which any desired indicia can be placed. In this way, an integrated gift box and greeting card can be effectively attained.

In the present invention, a pre-formed, visually exciting, unique, distinctive, and aesthetically pleasing gift or product holding system is attained by incorporating a pre-formed central section constructed for receiving and securely retaining a particular product having a fixed dimensional construction. As detailed above, the gift or product holding system of the present invention is constructed for receiving and securely holding video cassettes, audio cassettes, compact discs, and the like. Since each of these items are universally sold in uniformly sized cassettes or holders, each of these products have fixed dimensions, regardless of the audio or video information contained thereon. Consequently, the gift or product holding system of the present invention is constructed for receiving and securely retaining any desired product of this nature.

In the preferred embodiment, the central section of the gift holding system is constructed with four integrally connected panel members. In general, the central section comprises a top panel and a bottom panel which are in juxtaposed, spaced facing relationship with each other, and two side or edge panels, each of which are in juxtaposed, spaced, facing relationship with each other and interconnect one edge of the top panel with an edge of the bottom panel. Each panel member is dimensioned for conforming to the dimension of the product for which the holding system is created. In this way, the generally rectangular shaped receiving zone formed by the panel members enables the desired product to be easily securely positioned for retention therein.

By forming the central section in the manner detailed above, the top panel member and the edge panel members are easily folded into contact with the bottom panel member, thereby effectively collapsing the holding zone and enabling the gift-holding system of the present invention to be stored in a configuration requiring a minimum amount of space. In addition, whenever use of the holding system of the present invention is desired, the top panel is easily moved relative to the bottom panel for constructing the holding zone and enabling the desired product to be inserted therein for secure retention.

By employing this preferred construction, a gift or product holding zone is created which is open on two, juxtaposed side edges. In order to assure that any gift or product positioned in the holding zone of the central portion of the pre-formed gift or product holding system of the present invention is securely and safely retained therein, flap closure means are formed along at least one of the open side edges of the central portion.

In this way, storage of the pre-formed holding system of the present invention is easily attained, while secure retention of the product within the holding zone, once fully erected, is easily achieved by merely inserting the flap closure means into the holding zone for secure holding interengagement with the product retained therein. As a result, unwanted shifting or movement of the gift or product retained in the pre-formed holding system of the present invention is prevented and a substantially closed product retaining system is realized.

As discussed above, a further feature of the present invention is the incorporation of a pivotable or movable panel, which is constructed for providing a decorative, aesthetically pleasing visual effect to the gift or product holding system of the present invention, while also enabling the entire system to function as a combined, integrated gift holding box and greeting card, if desired. In this construction, the pivotable panel is integrally mounted along one edge of the bottom panel of the central section, extending therefrom with an intermediate, centrally disposed, panel member formed therewith.

In the preferred construction, the pivotable panel is mounted to the panel edge defining the sole remaining open zone of the central portion. In addition, the intermediate centrally disposed panel member of the pivotable portion is dimensioned for overlying the sole remaining open end of said central portion, forming a closure therefor. In this way, complete closure of the central portion is attained and a fully assembled, easily completed product retaining system is realized, with the desired product securely retained within the central portion thereof and a movable panel forming a decorative or message delivery member.

In order to further enhance the secure closure of the product holding system of the present invention, fastening means are preferably mounted on the outwardly facing surface of the top panel member of the central section which securely engages with the pivotable portion when placed in overlying contacting interengagement therewith. In this way, secure sealing of the entire product holding system is realized and an aesthetically pleasing, visually stimulating and event enhancing product holding system is attained.

In one embodiment of the present invention, the outwardly facing surface of the top panel member of the central section is constructed for enabling the user to write thereon in order to provide any desired personalized message to the recipient. In this way, the gift giver is able to personalize the gift and provide any desired message regarding the occasion for which the gift is being provided. As a result, the need for attaching a conventional greeting card to the gift is eliminated.

In order to provide a visually exciting and interest generating gift or product holding system, all visible surfaces of the entire holding system are printed with bright, colorful, decorative indicia. In this way, excitement and interest is generated and the occasion being celebrated is further enhanced. If desired, the pivotable panel may be constructed with pre-printed greeting card type indicia in order to further enhance the visual impact of a combined greeting card and gift holding container.

In a further embodiment of the present invention, the entire gift or product holding system is constructed from a single pre-formed card blank or member which is capable of being quickly and easily folded to attain the desired size and shape. Furthermore, the layout of the pre-formed blank employed for creating the gift or product holding system of the present invention is constructed in a unique manner which allows one surface of the blank to be printed, while the opposed surface remains unprinted.

By constructing the blank in this unique and distinctive manner and folding the blank along pre-formed fold lines, a completely printed gift or product holding system is created wherein all desired surfaces are preprinted and all unprinted surfaces form interior surfaces on which printing is not desired. In this way, the construction of the entire product is simplified and a unique, distinctive, and visually exciting gift or product holding system is realized which can be manufactured efficiently and at minimal costs.

The invention accordingly comprises an article of manufacture possessing the features, properties, and relation of elements which will be exemplified in the article hereinafter described and the scope of the invention will be indicated in the claims.

THE DRAWINGS

For a fuller understanding of the nature and objects of the invention, reference should be had to the following detailed description taken in connection with the accompanying drawings in which.

DETAILED DESCRIPTION

By referring to FIGS. 1–9, along with the following detailed discussion, the overall construction, assembly, and ease of use of the present invention can best be understood. For purposes of convenience, FIGS. 1–9 depict the embodiments of the present invention which is constructed for receiving and holding audio tapes. However, as discussed above, the present invention may be employed for other fixed dimensioned products, such as video cassettes, compact discs and the like, without departing from the scope of the present invention. It will thus be understood that the present invention can be employed for securely holding and retaining any fixed dimensioned product by merely constructing the gift/product holding system of the present invention in a manner consistent with the dimensions of the type of product to be retained therein.

Figure 1:
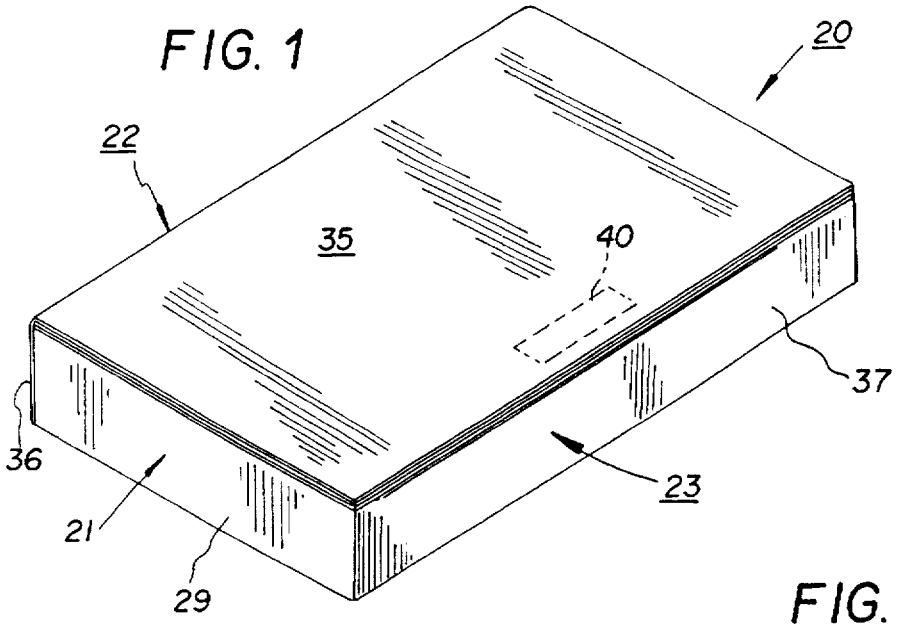
FIG. 1 is a perspective view of the gift/product holding system of the present invention shown fully assembled and its closed configuration.
Figure 2:
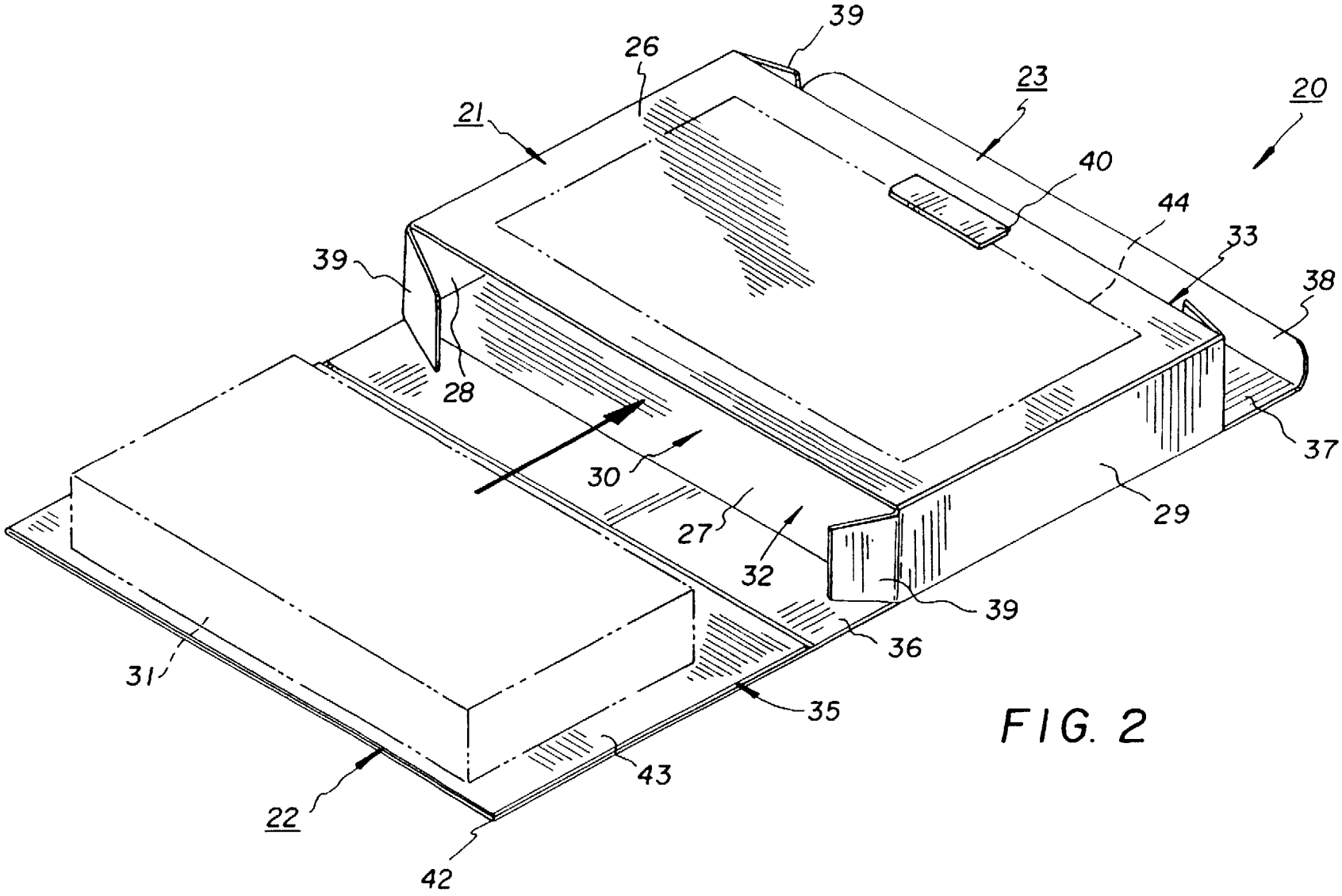
FIG. 2 is a perspective view of the gift/product holding system of the present invention shown fully assembled and in its open position, ready for receipt of a particular gift/product.
Figure 3:
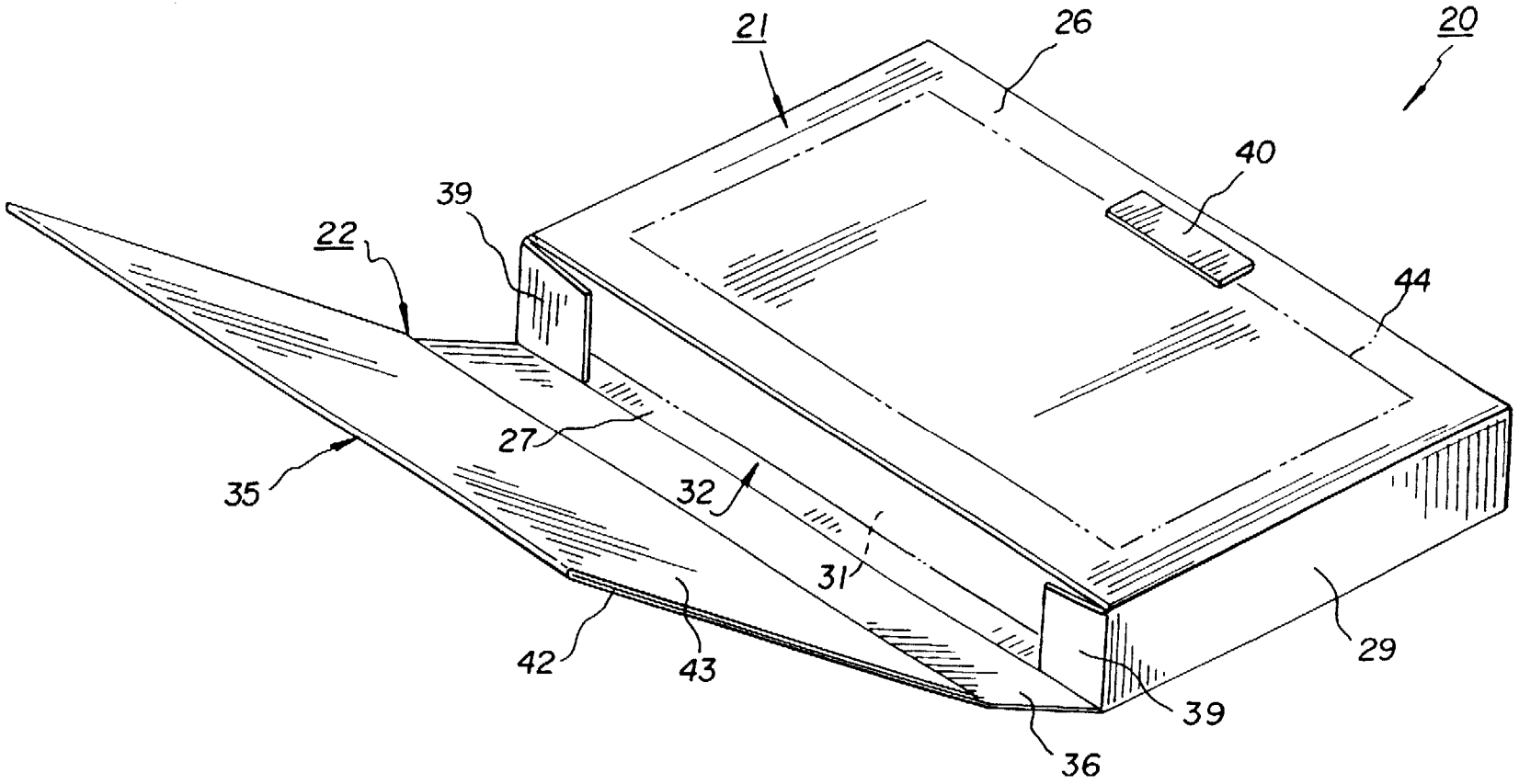
FIG. 3 is a perspective view of the gift/product holding system of the present invention shown fully assembled with a gift/product securely retained therein the process of being completely closed.

In FIG. 1, decorative, easily assembled gift/product holding system 20 of the present invention is depicted fully assembled to form a combined container and greeting card containing the desired product and ready for presentation to the recipient of the gift. In FIGS. 2 and 3, gift/product holding system 20 is depicted in the process of having the particular gift or product inserted therein and fully assembled for retaining the gift/product and being presented to the recipient.

As shown in FIGS. 1, 2 and 3, gift/product holding system 20 comprises, as its principal components, central section 21, large pivotal closure flap 22 and end closure flap 23. As best seen in FIG. 2, central section 21 preferably comprises a tube having a substantially rectangular overall shape which is dimensioned for receiving and securely holding the desired fixed dimensioned product. In FIGS. 2 and 3, the fixed dimensioned product is depicted as an audio cassette 31.

In the preferred construction, central section 21 comprises a top panel 26, a bottom panel 27 and two side or end panels 28 and 29. Each of these elements are integrally interconnected with each other forming substantially rectangular-shaped holding zone or chamber 30, constructed for securely receiving and retaining audio cassette 31.

By employing this construction, central section 21 is closed on two of its sides by end panels 28 and 29. The remaining two sides are preferably open, forming two alternate openings or entry portals 32 and 33 for holding chamber 30.

As clearly depicted in FIG. 2, in the preferred construction, pivotal flap 22 and end closure flap 23, which form closing structures both extend from the terminating edge of bottom panel 27. In this way, both entry portals 32 and 33 of holding chamber 30 can be completely closed when gift/product holding system 20 is fully assembled, thereby assuring secure and safe storage and retention of audio tape 31 therein.

As is more fully detailed below, enlarged pivotal flap 22 is preferably formed in two sections 35 and 36, which are integrally joined to each other along a common crease or fold line. Flap section 35 is enlarged and preferably constructed with overall dimensions substantially equivalent to the dimensions of top panel 26 of central section 21. In addition, intermediate section 36 is positioned between flap section 35 and panel 27, and is constructed with overall dimensions substantially equivalent to the size and shape of entry portal 32.

In this way, pivotal flap 22 is quickly and easily moved from its open position to its closed position, wherein intermediate section 36 overlies and effectively closes entry portal 32, while flap section 35 is easily pivoted into overlying engagement with top panel 26 of central section 21. This final position is depicted in FIG. 1 and represents the fully assembled position for transmitting the desired gift or product to the recipient.

End closure flap 23 is preferably constructed with two separate sections 37 and 38 which are integrally joined to each other along a single common fold line. In the preferred construction, portal closing section 37 is interconnected with bottom panel 27, extending therefrom along a fold line. In addition, portal closing section 37 is preferably constructed with dimensions substantially equivalent to the dimensions of entry portal 33 of holding chamber 30. In this way, entry portal 33 is capable of being completely closed, when so desired by the consumer.

In order to effectuate the desired closure of entry portal 33 of central section 21, end closure flap 23 is pivoted about the fold line of portal closing section 37 with bottom panel 27, while locking section 38 is inserted into entry portal 33 of holding chamber 30. Preferably, locking section 38 is constructed with tapered or rounded edges in order to enable the insertion and retention of locking section 38 in holding chamber 30 to be easily achieved. Once in its fully inserted and engaged position, end closure flap 23 is securely retained in its engaged position, assuring that the product or gift contained in holding chamber 30 is securely retained therein.

In the preferred construction, small, foldable tabs 39 are mounted at the free, terminating edges of end panels 28 and 29 and are constructed for being movable from a first outwardly extending position to a folded closed position, wherein tabs 39 cooperate with entry portals 32 and 33 to partially close the entry portals and assist in securing and retaining the product or gift mounted in holding chamber 30. In addition, tabs 39 also assist in securing and retaining locking section 38 of end closure flap 23 in the desired closed position.

By employing the components detailed above, the desired gift or product is quickly and easily inserted into holding chamber 30, using either entry portal 32 or 33, with portals 32 and 33 being fully closed, in the manner detailed above. In FIG. 2, audio tape 31 is depicted in the process of being inserted through entry 32 with entry portal 33 also open for use, if desired. In FIG. 3, audio tape 31 is depicted fully inserted in holding chamber 30, with entry portal 33 closed by end closure flap 23.

The complete, secure, retained engagement of audio tape 31 in gift/product holding system 20 is achieved by arcuately pivoting enlarged flap 22 about the fold line formed between flap 22 and bottom panel 27 of central section 21 in order to bring intermediate section 36 in overlying, closing, engagement with portal 32. This movement effectively closes portal 32 and assures secure retention of audio tape 31 in holding chamber 30.

The assembly of gift/product holding system 20 is completed by merely pivoting flap section 35 of pivotal flap 22 about the fold lines formed between flap section 35 and intermediate section 36 so as to position flap section 35 in overlying, contacting engagement with top panel 26 of central section 21. Once in this position, as depicted in FIG. 1, gift/product holding system 20 is fully assembled, ready for presentation to the recipient.

In the preferred embodiment, gift/product holding system 20 incorporates fastening means 40 mounted to top panel 26 of central section 21. Fastening means 40 is constructed for secure affixation to top panel 26, while also being engageable with flap section 35 when flap section 35 is pivoted into overlying, contacting engagement with top panel 26. This construction is most easily achieved by employing conventional dual side adhesive tape having an outer protective layer. In this way, fastening means 40 is mounted to top panel 26 and whenever affixation of flap section 35 to top panel 26 is desired, in order to maintain gift/product holding system 20 in its fully assembled and closed configuration, the covering strip is removed from fastening means 40 enabling the desired securement of flap section 35 to top panel 26.

Although the use of fastening means 40 is optional, the incorporation of fastening means 40 is preferred in order to assure that secure retention of the desired gift or product is attained when gift/product holding system 20 is fully assembled. As further detailed below, in order to fully enjoy the indicia printed on all surfaces of gift/product holding system 20, flap section 35 is easily removable from engagement with fastening means 40 in order to enable the recipient of the gift to enjoy all of the visual indicia on all printed surfaces, as well as any messages that may be contained thereon. In addition, by opening gift/product holding system 20 by disengaging flap section 35 from contact with fastening means 40, the recipient will also be able to obtain access to interior chamber 30 for removing the fixed dimension product securely retained therein.

In order to enhance the recipient's excitement in receiving a gift or product in gift/product holding system 20, the preferred construction of the present invention incorporates unique, distinctive, visually exciting and interest generating printed indicia on all of the surfaces of gift/product holding system 20 which are visible to the recipient. As fully detailed below, by employing the present unique construction and system forming blank, all surfaces on which printed indicia are desired are printed in a single pass. This is achieved by constructing the cardboard blank from which gift/holding system 20 is formed with all surfaces to be printed appearing on one side thereof. As a result, all surfaces to be printed can be printed simultaneously in a single pass, or multipasses for color, thereby providing optimum cost efficiency.

Figure 6:
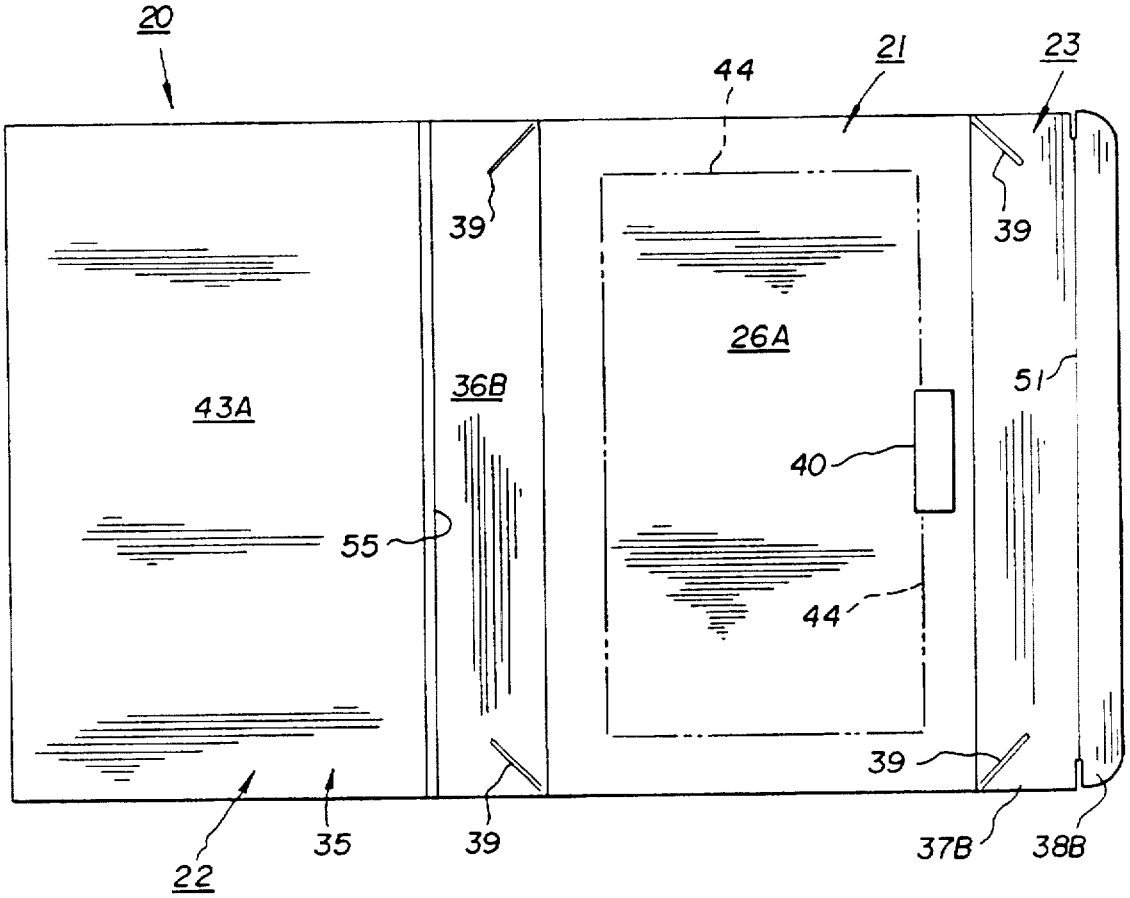
FIG. 6 is a top plan view of the cardboard blank employed for forming the gift/product holding system of the present invention depicted in its fully constructed and formed configuration.
Figure 5:
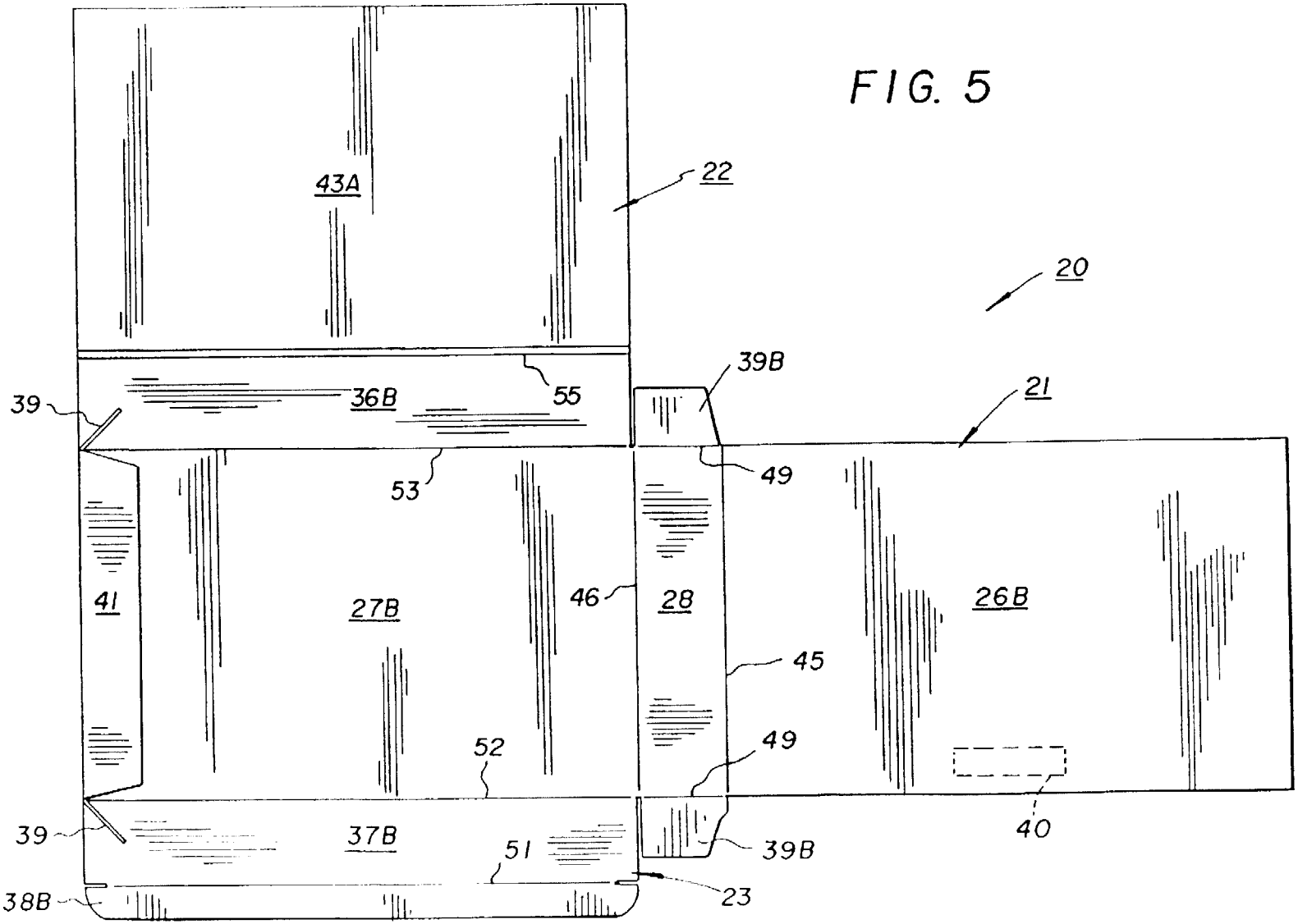
FIG. 5 is a top plan view of the cardboard blank employed for forming the gift/product holding system of the present invention depicted with the holding system partially constructed.

In order to best understand and fully disclose the construction of the preferred embodiment of the present invention, gift/holding system 20 is depicted in FIGS. 5 and 6 with the letter "A" added to the numeral reference for panels and segments of system 20 to define the surfaces upon which printed indicia is preferred, while the letter "B" is added to the numeral references to designate the surfaces thereof on which no printing is typically found. Although surfaces designated as printed surfaces are not required to bear printed indicia, the surfaces so designated are capable of being constructed with printed indicia in accordance with the present invention, if so desired. In addition, as will be readily apparent to one of ordinary skill in this art, any desired printed information, designs, colors, characters, etc. can be employed as the indicia without departing from the scope of this invention.

In the preferred construction, the exposed surface of top panel 26 is constructed with zone 44 printed thereon for enabling a personal message to be written by the gift giver to the recipient. Preferably, a plurality of lines are printed on top panel 26 in order to enable the gift giver to easily provide any desired message. However, any desired indicia can be printed on top panel 26 in addition to message receiving lines or, if desired, instead of the message lines.

In addition to providing decorative, visually stimulating indicia on the exposed surfaces of gift/product holding system 20, along with message receiving lines in zone 44 of top panel 26, the exposed surfaces of flap section 35 and, if desired, the exposed surface of top panel 26 may incorporate pre-printed messages as is typically found in conventional greeting cards. In this way, gift/product holding system 20 of the present invention can be constructed as a combined greeting card and gift container for further enhancing the use and practicality of the present invention. In any embodiment of this nature, any desired message can be pre-printed on any of the desired surfaces for providing a single, combined system wherein a gift can be securely retained and the entire message can be provided in a fully decorative, aesthetically pleasing, integrated system.

Figure 4:
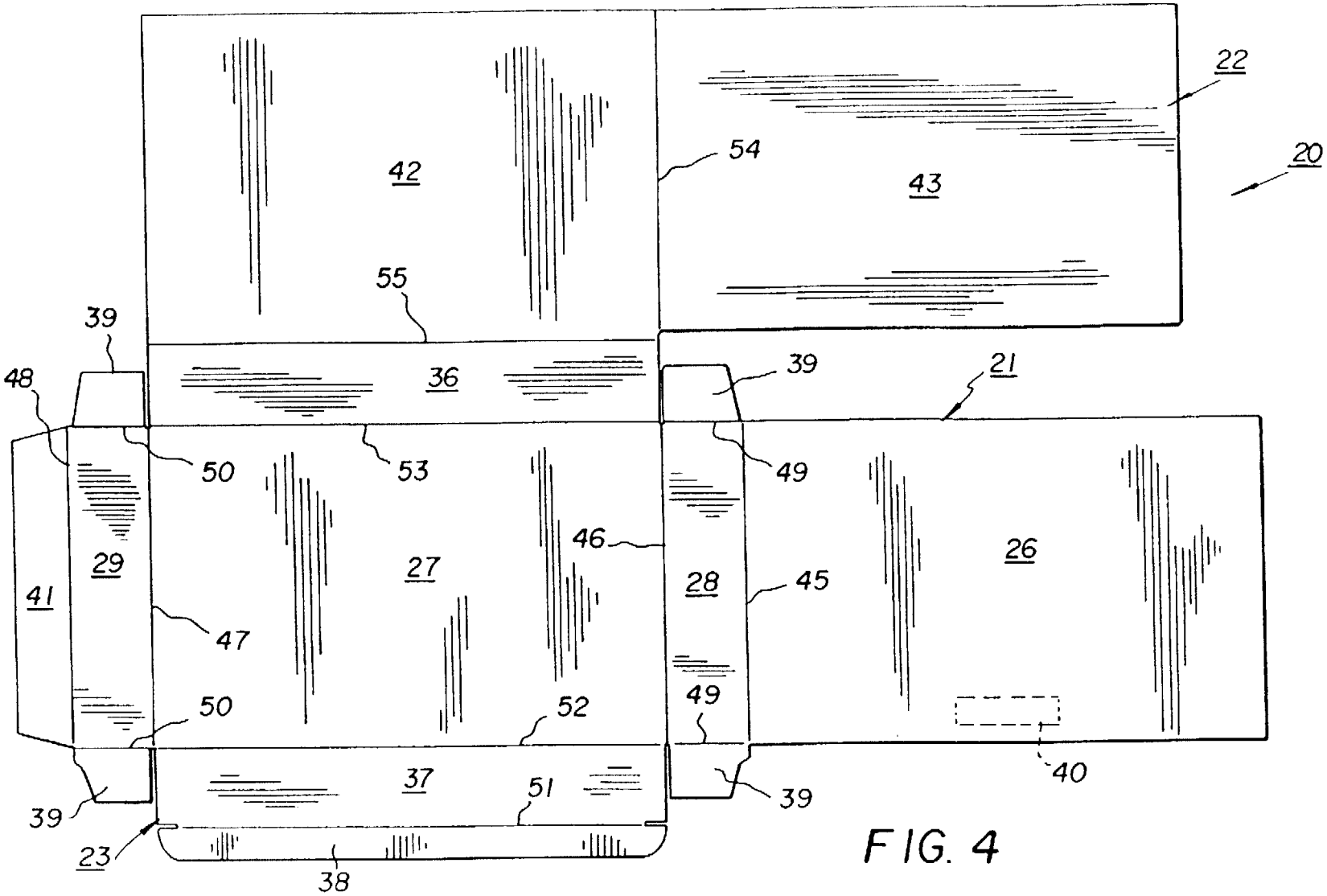
FIG. 4 is a top plan view of the cardboard blank employed for forming the gift/product holding system of the present invention depicted in its fully unfolded configuration.

By referring to FIGS. 4, 5, and 6, along with the following detailed description, the construction of the blank and the process for forming gift/holding system 20 from the blank can best be understood. In addition, the unique, easily achieved process for attaining a preformed, visually exciting, distinctive and aesthetically pleasing gift/product holding system for receiving and securely retaining a particular desired fixed dimensioned product is fully detailed. In the following disclosure, the preferred construction is provided. However, variations can be made to this preferred construction without departing from the scope of this invention.

In FIG. 4, the preferred construction of the cardboard blank for forming gift/holding system 20 is depicted in its fully opened, flat, planar configuration, prior to any assembly. In FIG. 4 all of the component segments of holding system 20 are fully detailed. In addition to these components, all of the fold lines interconnecting the various segments forming gift/product holding system 20 are also shown and discussed below.

The cardboard blank of gift/product holding system 20 of the present invention depicted in FIG. 4 represents the configuration of the unprinted side of the resulting gift/product holding system 20. The opposed side of holding system 20 represents the side to be printed, and the side which will form all of the visible surfaces on which decorative indicia is desired. In this way, gift/product holding system 20 of the present invention can be completely printed on one side thereof, thereby enabling the printing process to be achieved most expeditiously and inexpensively.

As shown in FIG. 4, central portion 21 is preferably constructed with top panel 26, bottom panel 27, and end panels 28 and 29 all adjacent to each other along a substantially continuous elongated strip. As depicted, top panel 26 is formed directly adjacent end panel 28 with fold or crease line 45 formed therebetween. Bottom panel 27 is positioned directly adjacent end panel 28 with fold or crease line 46 forming the juncture therebetween. In the preferred construction, fold lines 45 and 46 are in juxtaposed, spaced, substantially parallel relationship to each other.

End panel 29 is positioned directly adjacent bottom panel 27 with fold or crease line 47 forming the juncture therebetween. In addition, fold line 47 is formed in juxtaposed, spaced, substantially parallel relationship to fold lines 45 and 46. The construction of central portion 21 is completed by incorporating mounting panel 41 directly adjacent end panel 29 with fold line 48 forming the juncture therebetween. Fold line 48 is constructed in juxtaposed, spaced, substantially parallel relationship with fold line 47.

In the preferred embodiment, central section 21 incorporates a plurality of tabs 39 mounted to end panels 28 and 29. In the preferred embodiment, tabs 39, 39 are mounted to end panel 28 along fold lines 49, 49, both of which are in juxtaposed, spaced substantially parallel relationship to each other. Similarly, tabs 39, 39 are mounted to end panel 29 along fold lines 50, 50 with fold lines 50, 50 being in juxtaposed spaced substantially parallel relationship with each other.

As is apparent to one of ordinary skill in the art, tabs 39 can be eliminated, if so desired, in order to save assembly time and reduce construction details. Although tabs 39 can be eliminated without departing from the scope of the invention, the preferred embodiment of gift/product holding system 20 incorporates tabs 39 in order to assure the secure holding interengagement of the desired fixed dimension product in gift/product holding system 20, when fully assembled.

In this embodiment of the present invention, top panel 26 and bottom panel 27 are constructed with dimensions substantially equivalent to the length and width of the desired fixed dimension product to be retained therein. As shown in FIG. 4, top panel 26 and bottom panel 27 are constructed with a size and shape substantially equivalent to the length and width of a conventional audio cassette and housing.

Similarly, in order to assure the secure retained interengagement of audio cassette 31 in the holding chamber, once formed, end panels 28 and 29 are constructed with overall dimensions substantially equivalent to the sides or edges of the audio cassette or holder. In this way, once central section 21 is fully constructed, the desired audio cassette can be inserted in holding chamber 30 and securely retained therein.

As discussed above, end closure flap 23 comprises a portal closing section 37 and a locking section 38, which are integrally joined to each other along a single fold line 51. In addition, portal closing section 37 is integrally joined to bottom panel 27 along fold line 52. In the preferred construction, fold lines 51 and 52 are in juxtaposed, spaced parallel relationship to each other, and are formed substantially perpendicularly to fold lines 46 and 47 of bottom panel 27.

The construction of gift/product holding system 20 is completed by pivotal flap 22. As detailed above, pivotal flap 22 incorporates flap section 35 and intermediate section 36. As shown in FIG. 4, in the preferred construction, intermediate section 36 of pivotal flap 22 is mounted to bottom panel 27 along fold or crease line 53. Preferably, fold line 53 is formed in juxtaposed, spaced, parallel relationship with fold line 52 of end closure flap 23.

As clearly shown in FIG. 4, the preferred embodiment of the present invention is constructed with flap section 35 formed by two segments 42 and 43, which are integrally connected to each other along a single fold line 54. Preferably, fold line 54 is constructed to be substantially perpendicular to fold line 53. Preferably, segments 42 and 43 comprise substantially identical sizes and shapes and are constructed with such dimensions being substantially equivalent to the length and width of panels 26 and 27. In addition, as is more fully detailed below, the printed surface of segment 42 forms the top or outwardly facing surface of holding system 20, while the printed surface of segment 43 forms an inwardly facing surface.

The construction of gift/product holding system 20 of the present invention is completed by the integral engagement of segment 42 with intermediate section 36 along fold line 55. In the preferred embodiment, fold line 55 is constructed in juxtaposed, spaced, parallel relationship with fold line 53.

By employing this construction for the cardboard blank of gift/product holding system 20, a quickly assembled, and easily printed holding system is attained. In this construction, only one surface of gift/product holding system 20 needs to be printed to enable the entire holding system to have every desired exposed surface completely printed with any desired indicia thereon. By providing a system constructed with a single side requiring the printing, cost efficiency and production simplicity is realized.

In FIGS. 5 and 6, various stages of assembly of gift/product holding system 20 of this invention are depicted. By referring to these figures, along with the following detailed disclosure, the ease of construction of gift/product holding system 20 from the single blank depicted in FIG. 4 can best be understood. In addition, the printed and unprinted surfaces of the panels and segments forming holding system 20 are depicted using the designations "A" and "B", as detailed above.

FIG. 5 depicts the initial assembly of central section 21 which is attained by folding mounting panel 41 and end panel 29 upwardly along fold line 47 until end panel 29 is substantially perpendicular to bottom panel 27. Once in this position, mounting panel 41 is folded relative to edge panel 29 along fold line 48 until panel 41 is substantially perpendicular to end panel 29. Once these two panels have been folded along their respective fold lines, the construction depicted in FIG. 5 is attained, with tabs 39, 39 extending outwardly from end panel 29 above intermediate section 36 on one side and product closing section 37 on the opposite side.

In addition to depicting the initial formation of central section 21, FIG. 5 also shows the formation of flap section 35 of pivotal flap 22. By folding segment 43 about fold line 54 and bringing segment 43 into abutting contacting engagement with segment 42, flap section 35 is formed. In the preferred embodiment, the contacting surfaces of segments 42 and 43 are affixed to each other by suitable bonding or gluing means in order to form fully constructed flap section 35.

In this way, both exposed surfaces of flap section 35 incorporate any desired printed indicia, with the indicia being printed on both sides in a single, simultaneous pass. By employing this construction, printing of a single surface of gift/product holding system 20 is attained, while providing flap section 35 with printing on both its visible surfaces.

As shown in FIG. 6, the formation of holding system 20 is completed by folding end panel 28 upwardly, from the position depicted in FIG. 5, about fold line 46 until end panel 28 is positioned substantially perpendicularly to bottom panel 27. Then, top panel 26 is folded about fold line 45 to bring a portion of top panel 26 into contact with mounting panel 41. This operation also moves tabs 39, 39 into the desired position for use, as detailed above.

In order to complete the construction of central section 21 and holding system 20, adhesive means are placed on mounting panel 41, securely affixing top panel 26 to mounting panel 41. Once secure affixation of top panel 26 to mounting panel 41 has been achieved, the formation of central section 21 and holding system 20 is completed, with the precisely desired dimensions achieved for receiving and securely retaining the particular fixed dimension product in the holding chamber of central section 21. In addition, due to the ease of printing system 20 provides a visually exciting, fully decorated, festive construction which is achieved in a cost effective manner.

Figure 7:
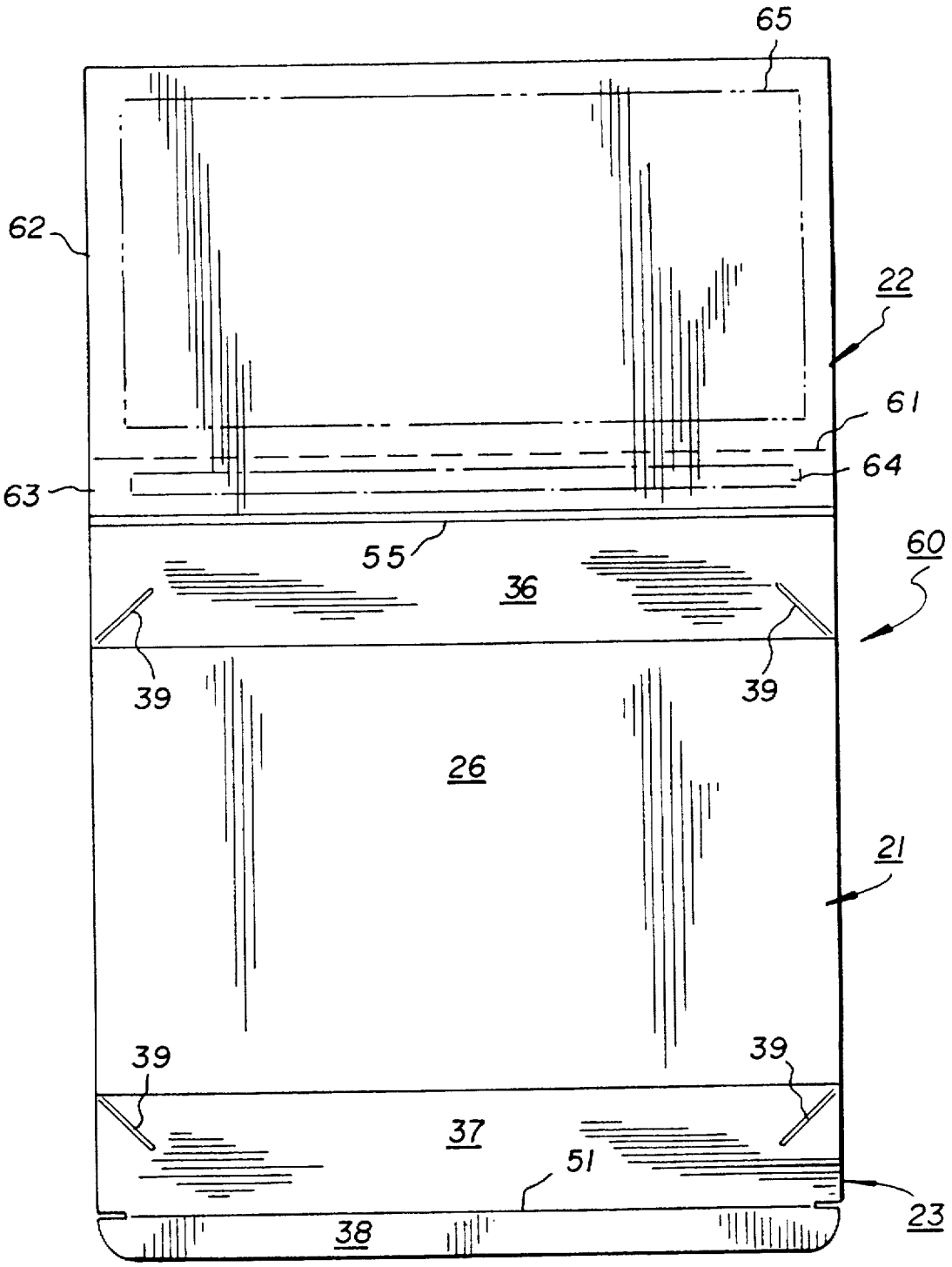
FIG. 7 is a top plan view of an alternate embodiment of the gift/product holding system of the present invention, shown in its fully opened position.
Figure 8:
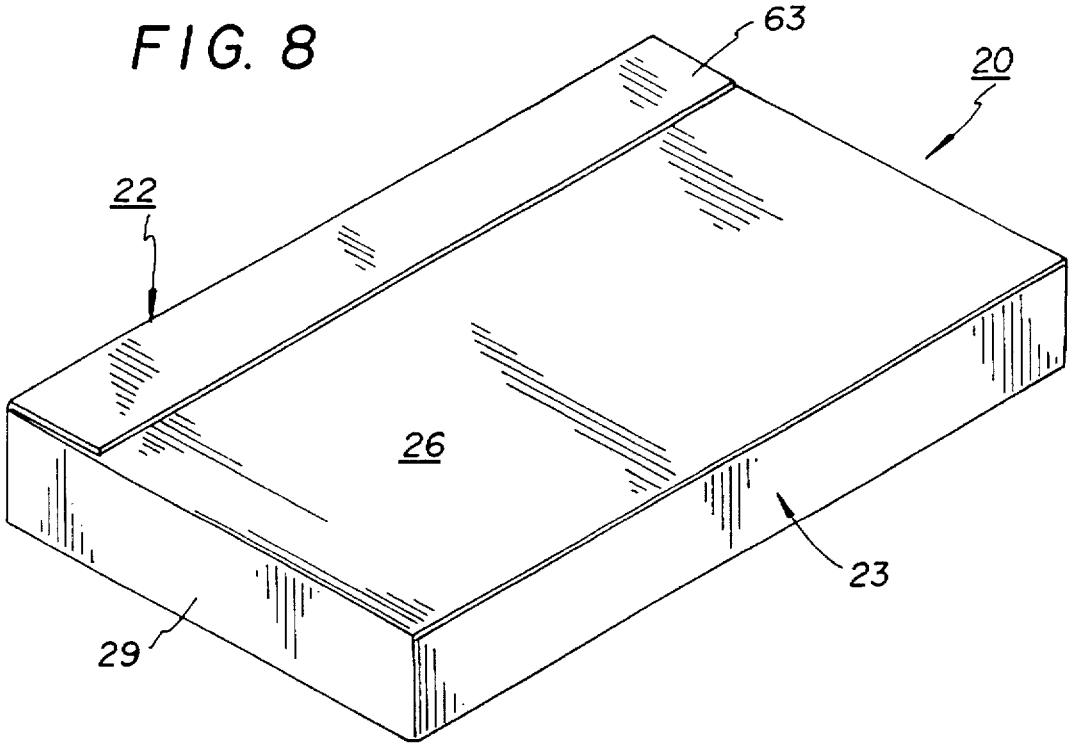
FIG. 8 is a top perspective view of the gift/product holding system of FIG. 7 shown in its closed position.
Figure 9:
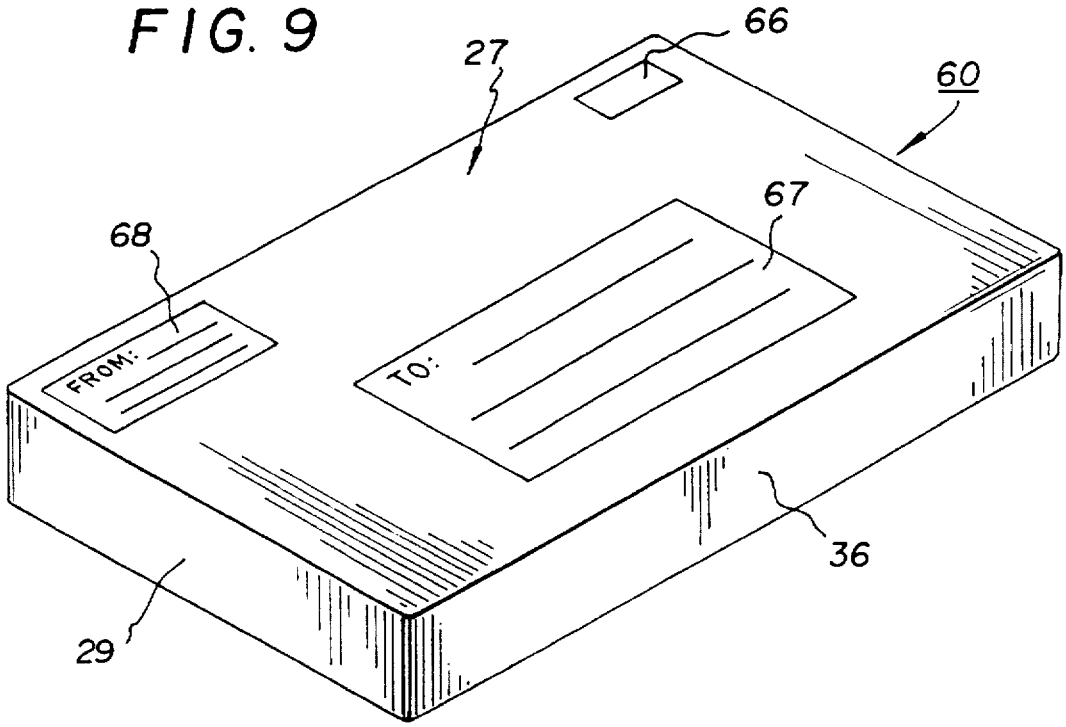
FIG. 9 is a bottom perspective view of the gift/product holding system of FIG. 8 showing the mailing zones thereof.

In FIGS. 7–9, an alternate embodiment of the present invention is depicted. In this embodiment, the gift/product holding system is constructed for holding and allowing easy mailing the desired gift to the recipient. In the preferred construction, a portion of the top movable panel or flap is employed as a message delivery means on which any desired message can be written, removed from the movable panel, and placed within the gift/product holding system prior to its closure for mailing.

As shown in FIG. 7, gift/product holding and mailing system 60 is constructed in a manner substantially identical to gift/product holding system 20 detailed above. In this regard, gift/product holding system 60 comprises a central section 21, dimensioned for securely retaining the desired fixed dimensioned gift or product, a large flap 22, and an end closure flap 23. As with the embodiments detailed above, central section 21 comprises a substantially rectangular overall shape and is dimensioned for receiving and securely holding any desired fixed dimensioned product, depicted as an audio cassette.

In this embodiment of the present invention, pivotal flap 22 is formed in the manner detailed above so as to enable both sides of flap 22 to incorporate printed indicia thereon, if desired. In addition, in this embodiment, gift/product holding and mailing system 60 incorporates a preformed perforated line 61 in pivotal flap 22 adjacent one edge of pivotal flap 22, substantially parallel to fold line 55. By incorporating perforated, tear-off line 61 in flap 22, flap 22 effectively comprises two separate sections 62 and 63.

As depicted in FIG. 7, section 62 of flap 22 comprises a major portion of flap 22 and incorporates most of the printed indicia formed on the surfaces of flap 22. Section 63 of flap 22 comprises a substantially smaller area and is preferably constructed with sealing means 64 affixed to one surface thereof, extending substantially the entire length of section 63. In this way, section 63 is easily fastened to panel 26, when desired, to securely close system 60.

By employing this construction, gift/product holding and mailing system 60 is quickly converted between a product holding assembly into a product holding and mailing assembly. In the preferred construction, portion 62 of flap 22 incorporates any desired indicia thereon, such as decorations or preprinted messages. If desired, zone 65 may be formed on at least one side thereof, comprising preformed lines or blank space for enabling the gift giver to write any desired message to the gift recipient.

In this way, gift/product holding and mailing system 60 is quickly and easily personalized prior to sending the gift to the recipient. In addition, once the desired message has been placed in zone 65 of portion 62, with portion 62 removed from portion 63, portion 62 is quickly and easily inserted into the retaining zone of central section 21 for being included with the particular gift stored therein.

Once section 62 and its associated message is placed in central section 21, flap 23 is closed, in the manner detailed above. Then, and panel 36 and 63 are pivoted in the manner detailed above, effectively closing the remaining opening entry portal of central section 21. Once portion 63 of flap 22 is pivoted into overlying, juxtaposed, spaced relationship with panel 26, adhesive means 62 is activated, in the particular manner required for the adhesive employed. Typically, such means as moisture, or removing a protective strip, is employed to activate sealing means 64 for secure affixation to panel 26. Once the sealing means 64 has been appropriately activated, portion 63 of flap 22 is brought into contacting engagement with panel 26, securely affixing portion 63 to panel 26 and effectively securely closing and sealing gift/product holding and mailing system 60.

By employing this construction of the present invention, any desired fixed dimensioned product is quickly and easily positioned in central section 21 with any desired message being placed upon portion 62 of flap 22 to personalize the gift-giving process. Once the desired message has been placed on portion 62, portion 62 is positioned in central section 21 and sealed therein, along with the desired gift by affixing portion 63 of flap 22 to panel 26.

As shown in FIG. 9, gift/product holding and mailing system 60 of the present invention is preferably constructed with panel 27 of central section 21 printed with mailing indicia. Although the mailing indicia can be eliminated or included in any desired format, FIG. 9 depicts one manner in which such indicia can be formed on panel 27.

As shown in FIG. 9, panel 27 incorporates a postage receiving zone 66, a recipient name and address zone 67, and a gift-giver zone 68 in which the name and address of the gift giver can be placed. By incorporating zones 66, 67, and 68 and panel 27 as part of the printing process of gift/product holding and mailing system 60, the use of system 60 as a gift holding and mailing system is further enhanced.

By employing these zones, the gift giver needs only to quickly fill out the name and address of the person receiving the gift as well as the name and address of the person giving the gift, placing the appropriate postage in zone 66 and merely deposit gift/product holding and mailing system 60 in any desired mail receiving receptacle. As a result, the desired gift is quickly and easily placed in gift/product holding and mailing system 60 and completely assembled for prompt delivery. In addition, by incorporating decorative, interest-generating, visually enhancing indicia on all exposed surfaces of gift/product holding and mailing system 60, as detailed above in reference to system 20, the excitement and interest generated by receiving the gift contained in holding and mailing system 60 is further enhanced.

In order to further promote the interest and excitement provided by gift/product holding and mailing system 60, panel 27 may incorporate, if desired, any desired interest generating and excitement enhancing indicia thereon in peripheral surrounding relationship to zones 66, 67, and 68. In this way, the desired information and postage zones are preserved for appropriate use, while the remainder of panel 27 is employed to further expand and increase interest and excitement, as provided by the visual stimulating indicia of panel 27 as well as the remaining panels of gift/product holding and mailing system 60.

In order to display gift/product holding system 20 or gift/product holding and mailing system 60 of the present invention in a most attractive and aesthetically pleasing manner, while also conserving space, it has been found that central section 21 can be easily collapsed by pivoting top panel 26 and end panels 28 and 29 about their respective fold lines in order to bring top panel 26 into juxtaposed, spaced, overlying contacting engagement with bottom panel 27. In addition, flap section 35, or flap sections 62 and 63 are also pivoted about fold line 55 thereby positioning outwardly facing segment 42 of flap section 35 or section 62 into its fully exposed position, as shown in FIG. 1.

By forming gift/product holding system 20 or gift/product holding and mailing system 60 into this configuration, a minimum amount of space is required, while also enabling gift/product holding system 20 or system 60 to be displayed with the printed indicia of segment 42 fully visible to the consumer. By displaying gift/product holding system 20 or system 60 in this configuration, system 20 or system 60 can be arranged in a manner typically found with greeting cards, enabling shoppers to see the plurality of alternate printed indicia and to easily select the desired system which best suits their needs.

It will thus be seen that the objects set forth above, among those made apparent from the preceding description, are efficiently attained and, since certain changes may be made in carrying out the above process and in the article set forth, without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Having described my invention, what I claim as new and desire to secure by Letters Patent is:

1. A combined container and greeting card for packaging a generally rectangular object, comprising:

a rectangular top panel, said top panel having a top surface, an inner surface, and indicia printed on the top surface;

a rectangular bottom panel of the same shape as the top panel and located parallel to and spaced from the top panel;

a pair of opposed edge panels having an identical shape and size to each other and connecting the top and bottom panels;

said top, bottom and edge panels forming a tube of rectangular cross section taken along a central portion thereof, and having a first opening at a first end thereof for insertion of an object into said tube;

a closing structure for closing said opening whereby said tube and closing structure form a container;

a cover flap overlying the top surface of the top panel and covering at least a major portion thereof, said cover flap being attached to the container and including a first fold-line which is foldable over and onto the top panel to cover said portion and foldable in a reverse direction to reveal the top surface of the top panel and a facing surface of the cover flap, whereby the cover flap and top surface of the top panel form a greeting card; and a fastening structure positioned between edges of at least one of said top surface of the top panel and said facing surface of the cover flap, said fastening structure being readily changeable between a first position in which the cover flap is freely movable away from the top panel to reveal said facing surface and top surface and a second position in which the cover flap and top panel are interconnected to prevent movement of the cover flap away from the top panel.

2. The container and greeting card according to claim 1 further comprising decorative indicia on at least one of said cover flap and said top panel.

3. The container and greeting card according to claim 1 wherein said fastening structure comprises an adhesive strip.

4. The container and greeting card according to claim 1 wherein said cover flap is attached to said bottom panel and includes a second fold line adjacent said bottom panel such that a portion of said flap cover between said fold lines forms the closing structure for said first opening.

5. The container and greeting card according to claim 1 wherein said container includes a second opening at a second end of said tube, a second closing structure for closing the second opening and a locking section for locking said second closing structure in a closed position, said second closing structure being attached to the container by a second fold-line, said locking section being attached to said second closing structure by a third fold-line, and wherein said locking section is located inside said tube when said second closing structure is in the closed position.

6. The container and greeting card according to claim 1 wherein said cover flap has a rectangular shape.

7. The container and greeting card according to claim 6 wherein said cover flap substantially completely covers said top panel.

8. A combination container/greeting card structure comprising:

(A) a container, comprising:

a rectangular top panel, said top panel having a top surface, an inner surface, and greeting card indicia printed on the top surface;

a rectangular bottom panel of the same shape as the top panel and located parallel to and spaced from the top panel;

a pair of opposed edge panels having an identical shape and size to each other and connecting the top and bottom panels;

said top, bottom and edge panels forming a tube defining an open space of rectangular cross section taken along a central portion thereof, and having a first opening at a first end thereof for insertion of a substantially rectangular object into said open space, and wherein said combination container/greeting card structure has no panels within said tube, such that the width of said open space is substantially equal to the distance between said edge panels, and such that the thickness of said space is substantially equal to the distance between said top and bottom panels; and a closing structure for closing said opening; and (B) a greeting card, comprising:

a cover flap overlying the top surface of the top panel and covering at least a major portion thereof, said cover flap being attached to the container and including a first fold-line which is foldable over and onto the top panel to cover said portion and foldable in a reverse direction to reveal the top surface of the top panel and a facing surface of the cover flap; and a fastening structure positioned between edges of at least one of said top surface of the top panel and said facing surface of the cover flap, said fastening structure being readily changeable between a first position in which the cover flap is freely movable away from the top panel to reveal said indicia and said facing surface and a second position in which the cover flap and top panel are interconnected to prevent movement of the cover flap away from the top panel.

9. The combination according to claim 8 wherein said container includes a second opening at a second end of said tube, a second closing structure for closing the second opening and a locking section for locking said second closing structure in a closed position, said second closing structure being attached to said second closing structure by a third fold-line, and wherein said locking section is located inside said tube when said second closing structure is in the closed position.

10. The combination according to claim 8 further comprising decorative indicia on said cover flap.

11. The container combination according to claim 8 wherein said fastening structure comprises an adhesive strip.

12. The combination according to claim 8 wherein said cover flap is attached to said bottom panel and includes a second fold line adjacent said bottom panel such that a portion of said cover flap between said fold lines forms the closing structure for said first opening.

13. The combination according to claim 8 wherein said cover flap has a rectangular shape.

14. The combination according to claim 13 wherein said cover flap substantially completely covers said top panel.

15. A packaged product/greeting card combination, comprising:

(A) a generally rectangular product having a generally rectangular upper surface, a generally rectangular lower surface, and a generally rectangular end surface;

(B) a container containing said generally rectangular product, said container comprising:

a rectangular top panel located adjacent said upper surface of said product, said top panel having a top surface, a bottom surface, and greeting card indicia printed on the top surface, and wherein the length and width of said rectangular top panel are substantially equivalent to the length and width of the upper surface of the product;

a rectangular bottom panel of the same shape and size as the top panel and located parallel to and spaced from the top panel, said bottom panel being located adjacent said lower surface of said product, and wherein the length and width of said rectangular bottom panel are substantially equivalent to the length and width of the lower surface of the product;

a pair of opposed edge panels having an identical shape and size to each other and connecting the top and bottom panels;

said top, bottom and edge panels forming a tube of rectangular cross section taken along a central portion thereof, and having a first opening at a first end thereof for insertion of said generally rectangular product into said tube, and a second opening at a second end of said tube, and wherein said packaged combination has no panels within said tube, such that the width of said generally rectangular product is substantially equal to the distance between said edge panels and such that the thickness of said generally rectangular product is substantially equal to the distance between said top and bottom panels;

a first closing structure for closing said first opening;

a second closing structure for closing the second opening, said second closing structure being attached to the container by a first fold-line; and a locking section locking said second closing structure in a closed position, said locking section being attached to said second closing structure by a second fold-line, and wherein said locking section is located inside said tube to releasably maintain said second closing structure in the closed position; and (C) a greeting card that is foldable between open and closed positions to selectively reveal and cover said greeting card indicia on said top panel, said greeting card comprising a cover flap overlying the indicia printed on the top panel and covering at least a major portion of said top panel, said cover flap being attached to the container and including a third fold-line which is foldable over and onto the top panel to cover said portion and foldable in a reverse direction to reveal the top surface of said top panel and a facing surface of the cover flap; and a releasable fastening structure positioned between edges of at least one of said top surface of the top panel and said facing surface of the cover flap, said fastening structure being readily changeable between a first position in which the cover flap is freely movable away from the top panel to reveal said indicia and said facing surface and a second position in which the cover flap and top panel are interconnected to prevent movement of the cover flap away from the top panel.

16. The packaged combination according to claim 15 further comprising decorative indicia on said cover flap.

17. The packaged combination according to claim 15 wherein said cover flap substantially completely covers said top panel.

18. The packaged combination according to claim 15 wherein said product comprises a compact disc.

19. The packaged combination according to claim 15 wherein said product comprises a video cassette.

* * * * *